US008469546B2

(12) United States Patent
Pedersen

(10) Patent No.: US 8,469,546 B2
(45) Date of Patent: Jun. 25, 2013

(54) DOUBLE SIDED LIGHT FIXTURE

(75) Inventor: Allan Pedersen, Aarhus (DK)

(73) Assignee: Martin Professional A/S, Aarhus N (DK)

( * ) Notice: Subject to any disclaimer, the term of this patent is extended or adjusted under 35 U.S.C. 154(b) by 237 days.

(21) Appl. No.: 13/062,584

(22) PCT Filed: Sep. 4, 2009

(86) PCT No.: PCT/DK2009/050226

§ 371 (c)(1),
(2), (4) Date: May 4, 2011

(87) PCT Pub. No.: WO2010/025737

PCT Pub. Date: Mar. 11, 2010

(65) Prior Publication Data

US 2011/0199770 A1 Aug. 18, 2011

(30) Foreign Application Priority Data

Sep. 5, 2008 (DK) ..... 2008 01234

(51) Int. Cl.
*F21S 4/00* (2006.01)

(52) U.S. Cl.
USPC ..... 362/249.03; 362/249.02; 362/249.07; 362/249.1; 362/240

(58) Field of Classification Search
USPC ..... 362/249.03, 249.02, 249.07, 249.1
See application file for complete search history.

(56) References Cited

U.S. PATENT DOCUMENTS 3,878,506 A * 4/1975 Young ..... 340/953
6,283,603 B1 * 9/2001 Lin ..... 362/35
6,737,809 B2 5/2004 Espiau et al.
2008/0165531 A1 * 7/2008 Belliveau et al. ..... 362/227
2009/0303724 A1 * 12/2009 Bjerre ..... 362/294
2010/0328466 A1 * 12/2010 Erel et al. ..... 348/164

FOREIGN PATENT DOCUMENTS

DE 297 20 165 U1 2/1998
FR 2 838 178 A1 10/2003
WO 01/73806 A1 10/2001

OTHER PUBLICATIONS

International Search Report for International Application No. PCT/DK2009/050226 Dated Sep. 23, 2009.

* cited by examiner

*Primary Examiner* — Evan Dzierzynski
(74) *Attorney, Agent, or Firm* — Roberts Mlotkowski Safran & Cole, P.C.; David S. Safran

(57) ABSTRACT

The present invention relates to a moving head light fixture, which moving head light fixture comprises a light generating head, which head is carried in a yoke, which head is rotatable to the yoke, which yoke is rotatable to a base, which head comprises electronic circuits for LED control. The moving head comprises a first and a second end section, which first and second end sections comprise a number of light sources. Hereby it can be achieved that the moving head light fixture which is able at the same time to generate a light into different directions. By having independent control over the light sources in both directions, it is possible to control the light from an external controller independently in both directions. The light sources could be formed out of a multiple of single light sources generating light at different colors. In this way it should be possible by means of an external command to the moving head light fixture to control the color of the light as well in the front direction and also in the opposite rear direction.

10 Claims, 4 Drawing Sheets

DOUBLE SIDED LIGHT FIXTURE

BACKGROUND OF THE INVENTION

1. Field of the Invention

The present invention relates to a moving head light fixture, which moving head light fixture comprises a light generating head, which head is carried in a yoke, which head is rotatable to the yoke, which yoke is rotatable to a base, which head comprises electronic circuits for LED control.

2. Description of Related Art

Single sided moving head light fixtures are well-known.

FR 2 838 178 discloses a spotlight. The spotlight has a face which supports a large number of red, green and blue luminescent diodes which are controlled by an electronic card at the rear to produce various color shades. The spotlight housing may be rotated about a horizontal axis by a motor and toothed belt and about a vertical axis by a motor and toothed belt.

SUMMARY OF THE INVENTION

It is the object of the pending application to form a double-sided moving head light fixture.

This can be achieved by a moving head light fixture as described in the preamble to claim 1 where the moving head further comprises a first and a second end section, which first and second end sections comprise a number of light sources.

Hereby it can be achieved that the moving head light fixture which is able at the same time to generate a light into different directions. By having independent control over the light sources in both directions, it is possible to control the light from an external controller independently in both directions. The light sources can be formed out of a multiple of single light sources and these light sources can generate light at different colors. In this way it should be possible by means of an external command to the moving head light fixture to control the color of the light as well in the front direction and also in the opposite rear direction.

The moving head is in one embodiment barrel shaped. The barrel-shaped light fixture can rotate more or less freely in a yoke so that a double light beam can scan the room if the light barrel is rotated. As the yoke can also be rotated in relation to a base, a double rotation of the head can perform a double light beam which is moving in two different directions.

The light sources can be formed of High Power LEDs. By using High Power LEDs for the light sources, it is possible to generate a relatively high intensity of light which light output can be further improved if the LEDs are operated together with TIR lenses which are able to concentrate the generated light from the LEDs.

The light sources can also be formed of UV LEDs. The UV LEDs can be extremely powerful but in order to generate a visible light, a color conversion is necessary. This color conversion can be performed in a phosphor filter that can be placed above the UV LEDs or integrated into TIR lenses. These phosphor filters can convert the UV light into white light which will be highly intensive.

The light sources can be formed of a video array consisting of low/medium power LEDs. It is possible at the end of the barrels to form a video array of e.g. LEDs so that the video output is generated from the end of the barrel.

The light sources can be formed of white LEDs. By using white LEDs it is possible in the front of the LEDs to perform an active filtration and in this way generate colored light. Otherwise by non-filtration, it is possible to generate an extremely powerful light beam of white light.

The light sources can be formed of Electrode Less Plasma Source (ELPS) bulb. By using the ELPS technology, it is possible to generate light at different colors but also white light can be generated and the light output will be extremely powerful. The ELSP can for instance be embodied as described in U.S. Pat. No. 6,737,809 and its continuations or as described in WO/0173806.

The barrel shaped casing can act as a heat sink. The barrel is formed of a number of dishes. These dishes are forming a very powerful heat sink. There will be extremely good airflow between the dishes and in that way effective cooling is achieved. Irrespective of which kind of light sources are used part of the power supplied to the light sources are coming out in the form of heat which has to be removed from the barrel.

An active fan cooling can be built in the barrel shaped head to remove heat from the casing. In order to increase the cooling, a cooling fan can be placed in the barrel in order to increase the air circulation inside the barrel and also the air circulation between the dishes forming the barrel.

DETAILED DESCRIPTION OF THE INVENTION

Figure 1:
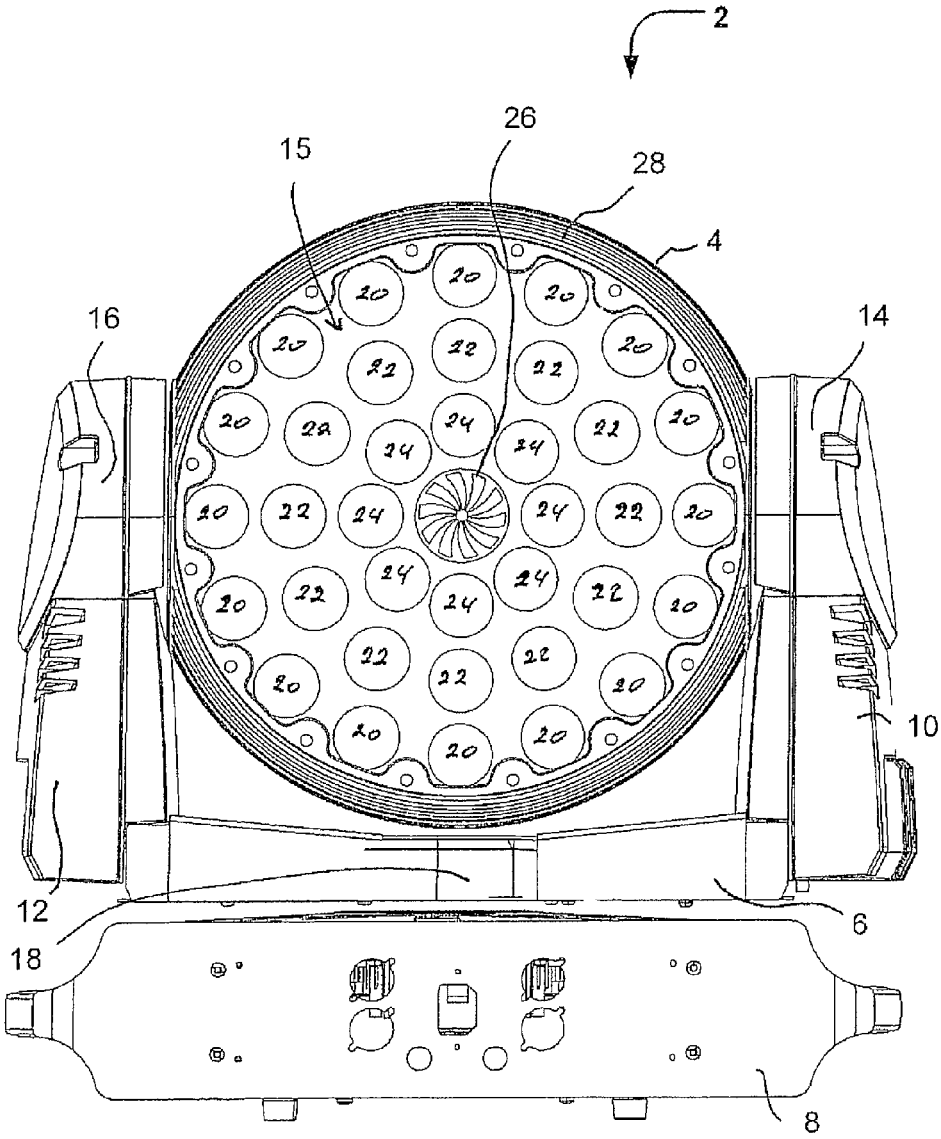
FIG. 1 shows the first possible embodiment for the invention.

FIG. 1 shows the first possible embodiment for the invention. A moving head light fixture 2 comprises a head 4 which head is rotatably supported in a yoke 6. Said yoke is rotatably supported by a base 8. The yoke comprises a first arm 10, a second arm 12 which first arm 10 ends in a bearing 14 which second arm 12 ends in a bearing 16. The bearings 14 and 16 are carrying the head 4. The head comprises at the front a number of lenses covering independent light sources. The lenses are forming three concentric circles at the FIG. 1 which outer circle is built of 16 lenses 20 where an circle placed inside comprises 12 lenses 22 and inside is further a circle of lenses comprising eight lenses 24. In the centre of the front end of the barrel is indicated a blower 26. Outside at the head 4 is indicated cooling dishes 28.

Figure 2:
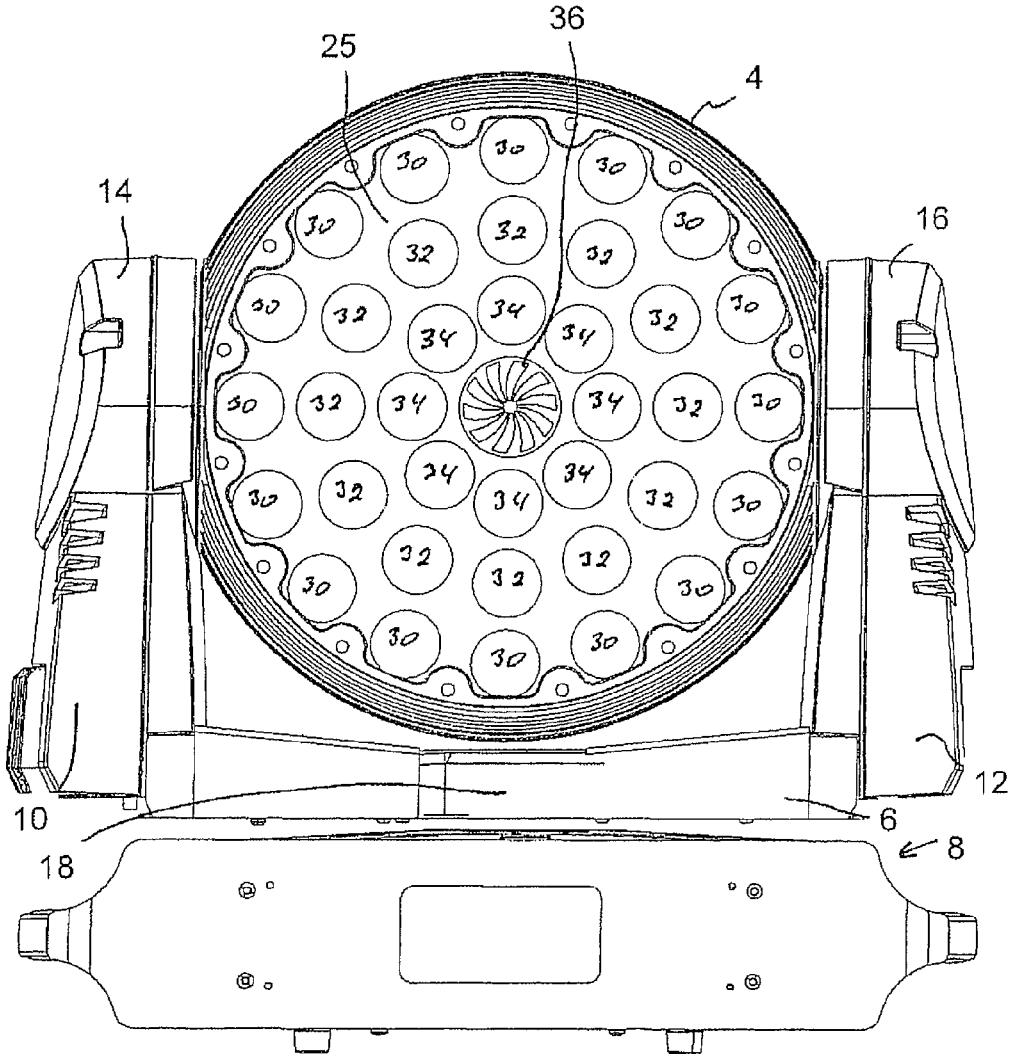
FIG. 2 shows the moving head light fixture seen from the rear.

FIG. 2 shows the moving head light fixture seen from the rear with the head 4 is seen from the back side. The head 4 is carried at a yoke 6 which yoke is carried by a base 8. The yoke comprises legs 10 and 12 and bearings 14 and 16. The head 4 has a rear surface 25 comprises a first circle of lenses 30, a second light of lenses 32 and an inner circle of lenses 34. In the centre is shown a blower 36.

Figure 3:
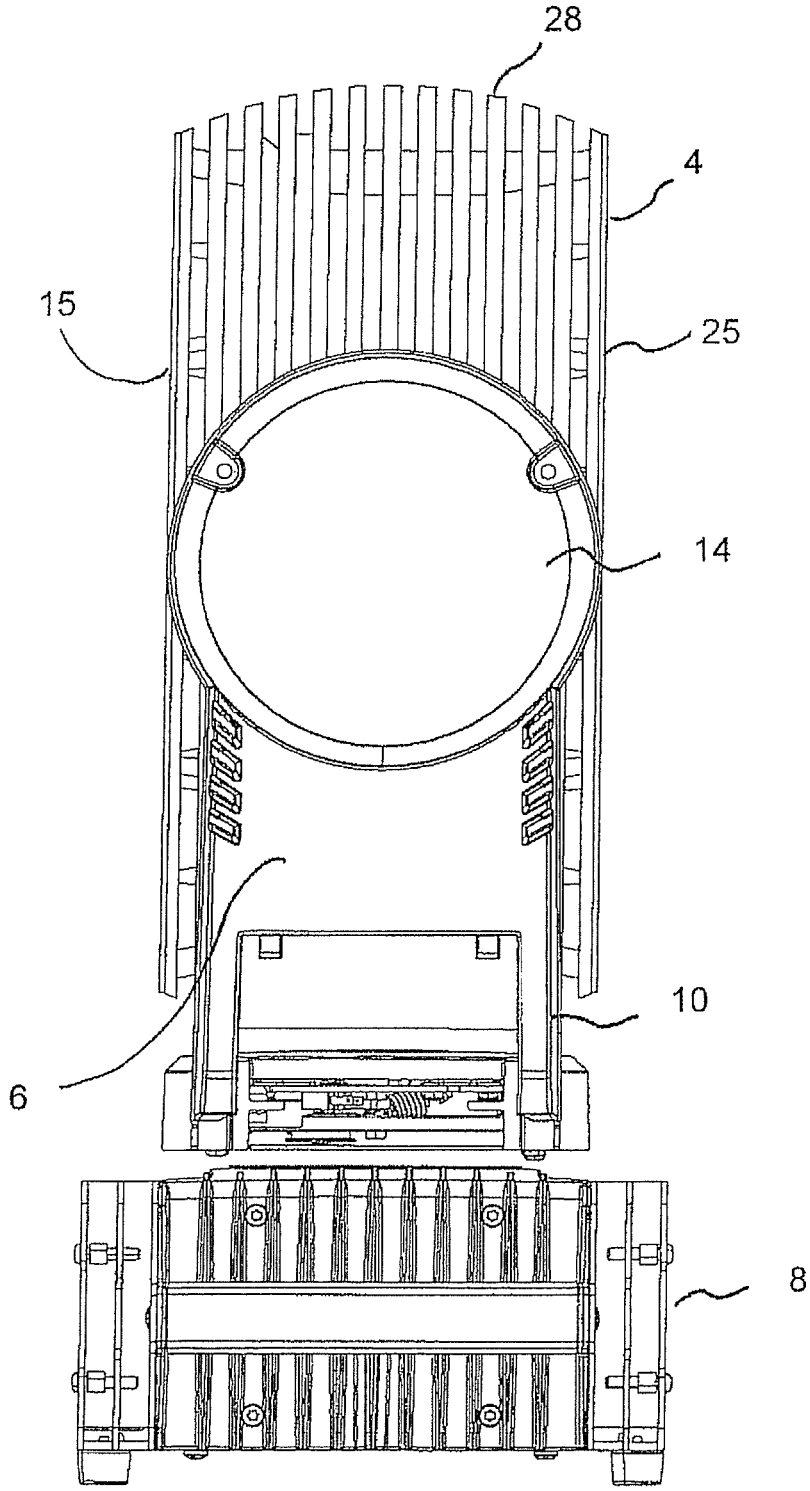
FIG. 3 shows the moving head light fixture 2 seen from the side.

FIG. 3 shows the moving head light fixture 2 seen from the side. The head 4 is carried at the yoke 6 and the yoke 6 is carried by the base 1. The yoke 6 comprises a first leg 10 and a bearing 14 for carrying the head 4. The head 4 comprises a front end 15 and a rear end 25. Further is indicated the dishes 28 at FIG. 3.

Figure 4:
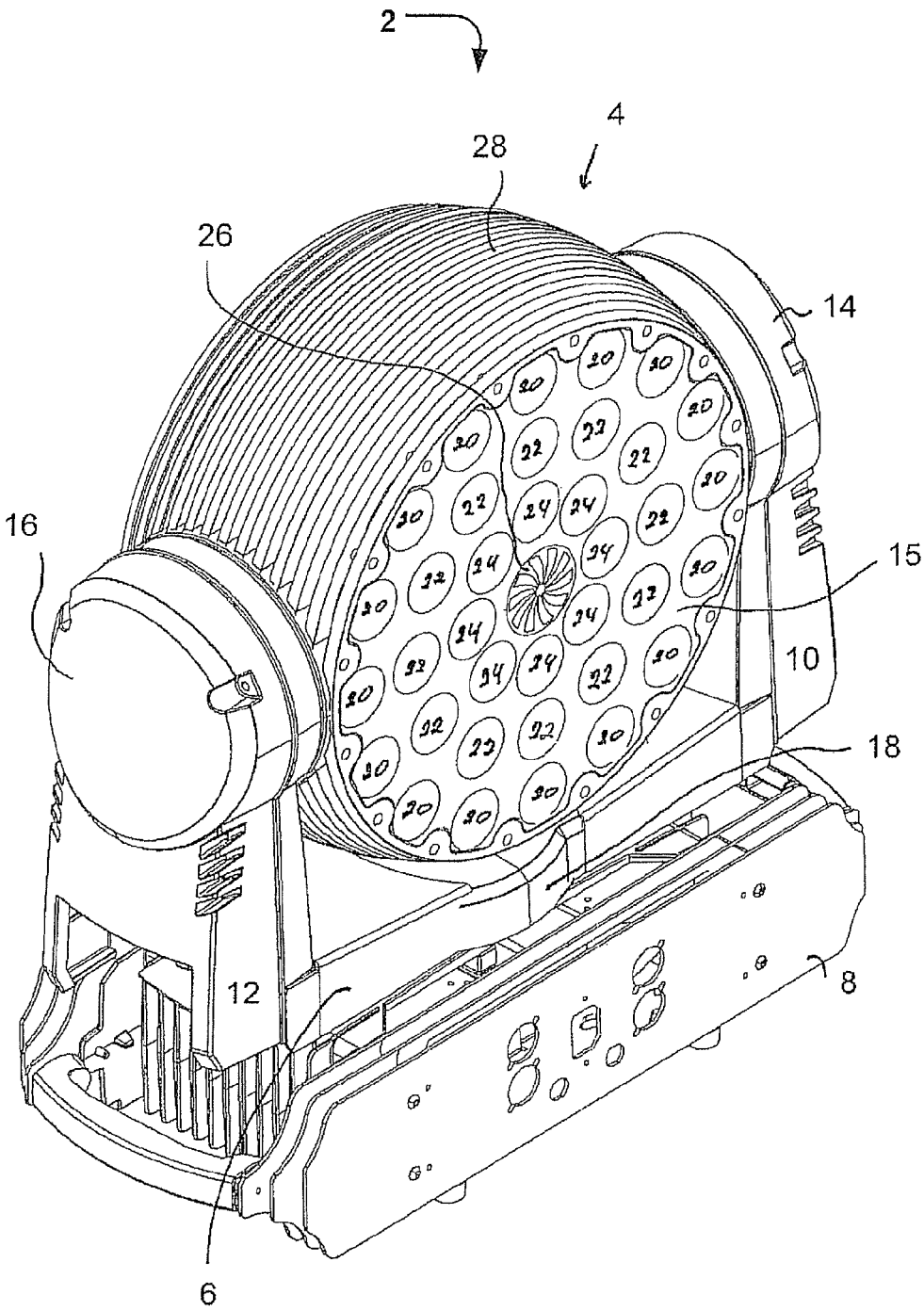
FIG. 4 shows a three-dimensional drawing of the invention.

FIG. 4 shows a three-dimensional drawing of the invention. At FIG. 4 is seen the moving head light fixture seen from the front. The head 4 is carried by a yoke 6 and the yoke is carried by the base 8. The yoke comprises legs 10, 12 and bearings 14, 16. The yoke 6 comprises a bearing 18 by which it is rotating in relation to the base 8. The head 4 comprises the front end 15 which comprises three concentric circles of lenses where the outer circle comprises lenses 20, the next inner circle comprises lenses 22 and the inner circle comprises lenses 24. In the centre is indicated a blower 26. Further at FIG. 4 the dishes 28 are seen.

Below the lenses 20, 22, 24 or 30, 32, 34 could be placed a color emitting TIR lens or a parabolic reflector. The light sources themselves can be different from light emitting diodes or it could be microwave resonators using bulbs for light generation.

The invention claimed is:

1. Moving head light fixture, which moving head light fixture comprises a light generating head, which head is carried in a yoke, which head is rotatable to the yoke, which yoke is rotatable to a base, which head comprises electronic circuits for LED control, characterized in that said moving head comprises a first and a second end section, which first and second end sections each have a face comprising a number of light sources, said faces being oppositely directed.

2. Moving head light fixture according to claim 1 characterized in that first and said second end section being independently controllable.

3. Moving head light fixture according to claim 2, characterized in that the moving head is barrel shaped.

4. Moving head light fixture according to claim 3, characterized in that the barrel shaped casing acts as a heat sink.

5. Moving head light fixture according to claim 4, characterized in that and active fan cooling is built in the barrel shaped head to remove heat from the casing.

6. Moving head light fixture according to claim 2, characterized in that at least one of said number of light sources are formed of High Power LEDs.

7. Moving head light fixture according to claim 2, characterized in that at least one of said number of light sources are formed of UV LEDs.

8. Moving head light fixture according to claim 2, characterized in that at least one of said number of light sources are formed of a video array consisting of low/medium power LEDs.

9. Moving head light fixture according to claim 2, characterized in that at least one of said number of light sources are formed of white LEDs.

10. Moving head light fixture according to claim 2, characterized in that at least one of said number of light sources are formed of an ELPS light source.

* * * * *